US010527303B2

(12) United States Patent
Maisey et al.

(10) Patent No.: US 10,527,303 B2
(45) Date of Patent: Jan. 7, 2020

(54) LOAD FOLLOWER AND LOAD ANTICIPATOR FOR A LIQUID DESICCANT AIR CONDITIONING SYSTEM

(71) Applicants: Grahame Ernest Maisey, Wyncote, PA (US); Beverly Milestone, Wyncote, PA (US)

(72) Inventors: Grahame Ernest Maisey, Wyncote, PA (US); Beverly Milestone, Wyncote, PA (US)

( * ) Notice: Subject to any disclaimer, the term of this patent is extended or adjusted under 35 U.S.C. 154(b) by 0 days.

(21) Appl. No.: 16/192,974

(22) Filed: Nov. 16, 2018

(65) Prior Publication Data

US 2019/0145643 A1 May 16, 2019

Related U.S. Application Data

(60) Provisional application No. 62/586,951, filed on Nov. 16, 2017.

(51) Int. Cl.

| | |
|---|---|
| ***F24F 3/02*** | (2006.01) |
| ***F24F 11/00*** | (2018.01) |
| ***F24F 3/14*** | (2006.01) |
| ***F25B 35/02*** | (2006.01) |
| ***F24F 3/06*** | (2006.01) |
| ***F24F 3/08*** | (2006.01) |
| ***F24F 3/04*** | (2006.01) |
| ***F24F 3/10*** | (2006.01) |
| ***F24F 13/26*** | (2006.01) |

(52) U.S. Cl.

CPC ..... *F24F 11/0008* (2013.01); *F24F 3/02* (2013.01); *F24F 3/04* (2013.01); *F24F 3/06* (2013.01); *F24F 3/065* (2013.01); *F24F 3/08* (2013.01); *F24F 3/10* (2013.01); *F24F 3/1417* (2013.01); *F24F 3/1429* (2013.01); *F24F 13/26* (2013.01); *F25B 35/02* (2013.01)

(58) Field of Classification Search

CPC .... F24F 3/1417; F24F 3/02; F24F 3/04; F24F 3/06; F24F 3/065; F24F 3/08; F24F 3/10; F24F 11/008; F24F 3/1429; F24F 13/26; F25B 35/02

See application file for complete search history.

(56) References Cited

U.S. PATENT DOCUMENTS

| | | | | |
|---|---|---|---|---|
| 2,672,024 A | | 3/1954 | McGrath | |
| 4,521,350 A | | 6/1985 | Lefevre | |
| 5,024,062 A | * | 6/1991 | Hellman ..... | B01D 53/263 62/272 |

(Continued)

*Primary Examiner* — David J Teitelbaum
(74) *Attorney, Agent, or Firm* — Riverside Law LLP

(57) ABSTRACT

A liquid desiccant air conditioning system comprises an energy exchange unit comprising a sump and a plurality of media pads positioned above the sump, first, second, and third desiccant outlets fluidly connected to the sump, and at least one retractable gate positioned above the sump, configured to partition the sump into at least first and second compartments, wherein the first compartment is fluidly connected to the first desiccant outlet and the second compartment is fluidly connected to the second desiccant outlet, and wherein effective volumes of the first and second compartments can be modified by opening and closing the at least one retractable gate. A method of controlling desiccant circulation in a liquid desiccant air conditioning system is also described.

13 Claims, 4 Drawing Sheets

(56) References Cited

U.S. PATENT DOCUMENTS

| | | | | |
|---|---|---|---|---|
| 5,097,895 | A * | 3/1992 | Assaf | F01K 11/02 165/104.14 |
| 5,351,497 | A | 10/1994 | Lowenstein | |
| 6,513,339 | B1 | 2/2003 | Kopko | |
| 7,765,827 | B2 | 8/2010 | Schlom | |
| 8,800,308 | B2 | 8/2014 | Vandermeulen | |
| 9,086,223 | B2 | 7/2015 | Vandermeulen | |
| 9,377,207 | B2 | 6/2016 | Vandermeulen | |
| 9,631,824 | B1 | 4/2017 | Maisey | |
| 2011/0101549 | A1* | 5/2011 | Miyauchi | B01D 53/1425 261/151 |
| 2015/0241148 | A1 | 8/2015 | Curtis | |
| 2015/0292754 | A1* | 10/2015 | Mongar | F24F 3/1417 62/94 |

* cited by examiner

LOAD FOLLOWER AND LOAD ANTICIPATOR FOR A LIQUID DESICCANT AIR CONDITIONING SYSTEM

CROSS-REFERENCE TO RELATED APPLICATIONS

This application claims priority to U.S. Provisional Patent Application No. 62/586,951, filed on Nov. 16, 2017, incorporated herein by reference in its entirety.

FIELD OF THE INVENTION

This invention relates to load following and load anticipating, alone or in combination, in desiccant sumps used for collecting liquid desiccant in a liquid desiccant air conditioning (LDAC) system. Exemplary LDAC systems generally comprise a conditioner unit with desiccant sumps, a storage system or sumps used as a storage system, and an energy recovery/regenerator unit with desiccant sumps. A conditioner unit and energy recovery/regenerator unit that have more than one sump may comprise a cross-flow system wherein the air moves in a generally horizontal direction and the liquid desiccant moves in a generally vertical direction. The conditioner unit and energy recovery/regenerator unit may also comprise air washers on the air intake side and filters.

BACKGROUND OF THE INVENTION

Liquid desiccant air conditioning systems recirculate, regenerate and recover energy in the liquid desiccant to be continuously reused as the working fluid. In most systems, once the liquid desiccant has run through the conditioner unit, all of the liquid desiccant will flow directly back into the energy recovery/regenerator unit or storage unit regardless of its state. In systems where the conditioner unit has more than one sump, some liquid desiccant will flow into the energy recovery/regenerator unit, while other liquid desiccant will flow into the storage unit, remain in the holding sump, or be recirculated back into the conditioner unit.

No current system takes into account variations in energy transfer "work" performed by the liquid desiccant in the media pads, and therefore current systems lack flexibility and adaptability to different or varying loads. Such systems are static and thus do not adapt to changing load requirements from the space conditioned, the process being served, or the changing condition of the air being supplied to the conditioner unit or the energy recovery/regenerator unit.

For the foregoing reasons, there is a need in the art for a liquid desiccant air conditioning system comprising load followers, load anticipators, or a combination of the two in some or all sumps. Such a system improves cooling and heating in the conditioner unit, regeneration and energy recovery in the energy recovery/regenerator unit, and heat for the energy recovery/regenerator unit throughout varying loads on the conditioner unit and energy recovery/regenerator unit. Such a system will further allow for changing load requirements from the space conditioned or process served and the outside humidity and temperature changes. The present invention satisfies this need.

SUMMARY OF THE INVENTION

In one aspect, a liquid desiccant air conditioning system comprises an energy exchange unit comprising a sump and a plurality of media pads positioned above the sump, first and second desiccant outlets fluidly connected to the sump, and at least one retractable gate positioned in the sump, configured to partition the sump into at least first and second compartments, wherein the first compartment is fluidly connected to the first desiccant outlet and the second compartment is fluidly connected to the second desiccant outlet, and wherein effective volumes of the first and second compartments can be modified by opening and closing the at least one retractable gate.

In one embodiment, the first desiccant outlet is fluidly connected to a recirculating desiccant inlet of the energy exchange unit. In one embodiment, the second desiccant outlet is fluidly connected to a storage unit. In one embodiment, the system further comprises a third desiccant outlet fluidly connected to the sump, wherein the at least one retractable gate positioned in the sump is further configured to partition the sump into a third compartment, the third compartment fluidly connected to the third desiccant outlet, and wherein the third desiccant outlet is fluidly connected to a second energy exchange unit.

In one embodiment, the second desiccant outlet is fluidly connected to a storage unit. In one embodiment, the second desiccant outlet is fluidly connected to a second energy exchange unit. In one embodiment, the second desiccant outlet is fluidly connected to a second energy exchange unit. In one embodiment, one of the retractable gates is configured to partition the sump such that at least one media pad is positioned partially in one compartment and partially in another compartment. In one embodiment, the system further comprises a control system comprising a temperature sensor and an actuator, the actuator configured to actuate at least one of the retractable gates in response to a signal received from the control system. In one embodiment, the control system further comprises a humidity sensor communicatively connected to the control system. In one embodiment, the control system further comprises at least one desiccant level sensor positioned in the sump. In one embodiment, a first desiccant level sensor is positioned in the first compartment and a second desiccant level sensor is positioned in the second compartment, the first and second desiccant level sensors communicatively connected to the control system.

In another aspect, a method of controlling desiccant circulation in a liquid desiccant air conditioning system comprises the steps of closing a first retractable gate in an energy exchange unit having a plurality of media pads and a sump, wherein the gate partitions the sump into first and second compartments, circulating a quantity of liquid desiccant from the first compartment back into the energy exchange unit, and circulating a quantity of liquid desiccant from the second compartment into a storage unit. In one embodiment, the method further comprises the steps of opening the first retractable gate in the energy exchange unit, closing a second retractable gate in the energy exchange unit, wherein the second gate partitions the sump into third and fourth compartments, the third and fourth compartments having different relative capacity to the first and second compartments, circulating a quantity of liquid desiccant from the third compartment back into the energy exchange unit, and circulating a quantity of liquid desiccant from the fourth compartment into a storage unit.

In one embodiment, the method further comprises the steps of measuring a temperature with a temperature sensor, comparing the temperature with a predetermined threshold, and, if the temperature is below the predetermined threshold, opening the first retractable gate. In one embodiment, the method further comprises the steps of measuring a level of humidity with a humidity sensor, comparing the humidity measurement with a predetermined threshold, and, if the humidity is below the predetermined threshold, opening the first retractable gate. In one embodiment, the method further comprises the step of, if the temperature is above the predetermined threshold, closing a second retractable gate. In one embodiment, the method further comprises the step of, if the humidity is above the predetermined threshold, closing a second retractable gate. In one embodiment, the method further comprises the steps of measuring a first desiccant level in the first compartment using a first fluid level sensor, measuring a second desiccant level in the second compartment using a second fluid level sensor, and, if the first desiccant level exceeds a predetermined threshold, opening the first retractable gate.

BRIEF DESCRIPTION OF THE DRAWINGS

The foregoing purposes and features, as well as other purposes and features, will become apparent with reference to the description and accompanying figures below, which are included to provide an understanding of the invention and constitute a part of the specification, in which like numerals represent like elements, and in which.

DETAILED DESCRIPTION

Figure 1:
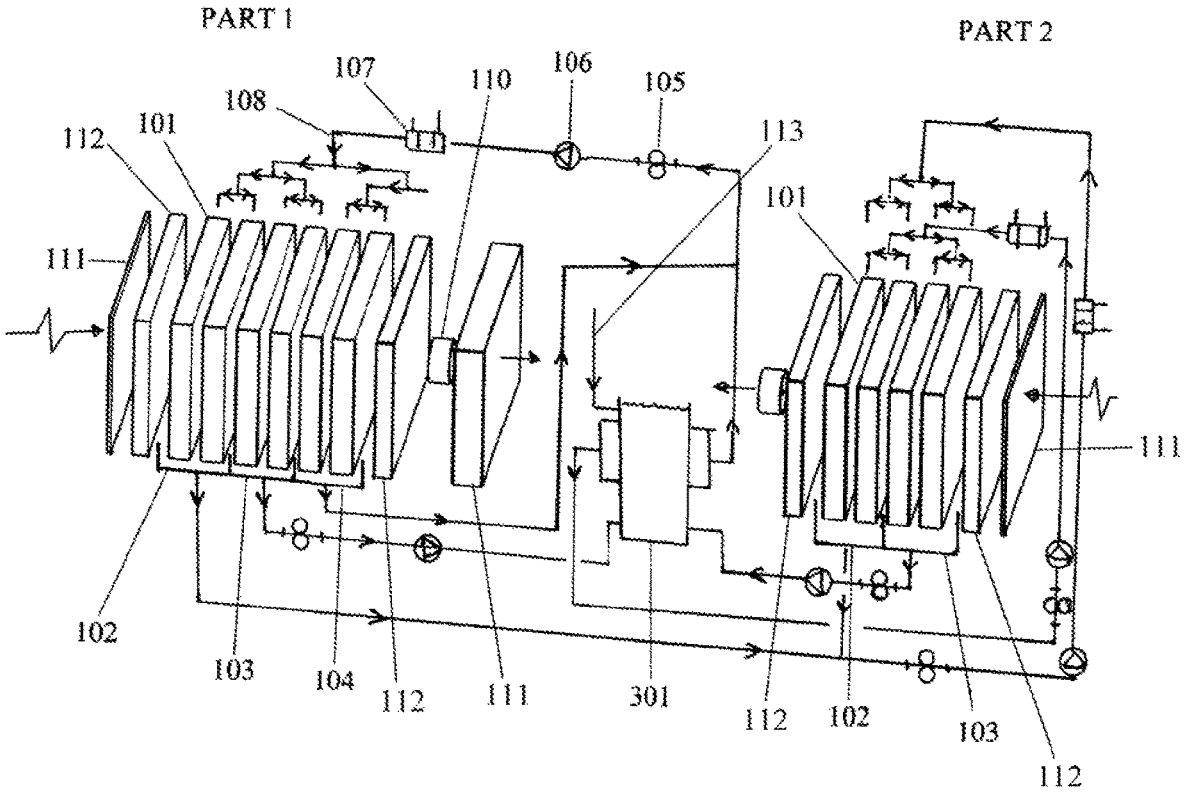
FIG. 1 is an exemplary schematic of an LDAC system.

It is to be understood that the figures and descriptions of the present invention have been simplified to illustrate elements that are relevant for a clearer comprehension of the present invention, while eliminating, for the purpose of clarity, many other elements found in climate control systems and methods and gates in collection sumps. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined otherwise, all technical and scientific terms used herein have the same meaning as commonly understood by one of ordinary skill in the art to which the invention belongs. Although methods and materials similar or equivalent to those described herein can be used in the practice or testing of the present invention, the preferred methods and materials are described herein.

The articles "a" and "an" are used herein to refer to one or more than one (i.e. to at least one) of the grammatical object of the article. By way of example, "an element" means one element or more than one element.

Systems of the present invention comprise one or more "gates." As used herein, a gate is any device capable of separating, partitioning, or sealing a sump from other sumps. Examples of gates include, but are not limited to, hinged gates, drop gates, gates with an openable window or door, or any other type of gate capable of separating one sump from another. One or more gates may be placed between each media pad, may split media pads, or may be otherwise positioned throughout the system as suitable to accomplish the methods of the present invention.

As discussed in further detail below, disclosed herein are various embodiments of methods and systems of moveable gates that are capable of opening, closing, and sealing depending upon the load on the conditioner unit and the most required function of the energy recovery/regenerator unit. In some embodiments, the gates open and close to allow or restrict the flow of liquid desiccant between the one or more sumps. In some embodiments, the gates are either fully opened or fully closed, and desiccant flow is either stopped or unrestricted. In other embodiments, the gates may partially open, to restrict, but not stop, the flow of desiccant between sumps. In some embodiments, the gates may operate only between adjacent sumps, but in other embodiments, the gates may be combined with one or more bypass conduits in order to allow or constrict desiccant flow between two sumps that are not adjacent to one another. In some embodiments, the gates control desiccant flow from the conditioner unit to one or more of the storage unit, a sump which acts as the storage unit, or the energy recovery/regenerator unit. In some embodiments, the gates control desiccant flow from the energy recovery/regenerator unit to one or more of the storage unit, a sump which acts as the storage unit, or the conditioner unit. In some embodiments, the one or more gates may additionally or alternatively control desiccant recirculation flow, i.e. flow from one part of the conditioner unit to another part of the conditioner unit, or from one part of the energy recovery/regenerator unit to another part of the energy recovery/regenerator unit. In some embodiments, flow patterns implemented by the one or more gates vary depending upon the load requirements or functions.

As discussed in further detail below, some embodiments of the present invention comprise a load follower, a load anticipator, or a combination of the two located in sumps used for collecting liquid desiccant in an LDAC system. Embodiments of an LDAC system of the present invention comprise one or more energy exchange units, wherein an energy exchange unit may be a conditioner unit performing an air conditioning function on a quantity of air or an energy recovery/regenerator unit performing energy recovery on a quantity of liquid desiccant. Some embodiments of an LDAC system comprise a conditioner unit, a storage system, and an energy recovery/regenerator unit. In some embodiments, an LDAC system of the present invention comprises a set of sumps instead of, or in addition to, the storage system. The system may be configured to follow the load, anticipate the load, or both, and may adjust the sumps and the gates between the sumps according to the varying loads. An air conditioning system of the present invention may be any size, including but not limited to a large-scale industrial unit, an institutional unit, a commercial unit, a residential unit, or a single room unit. A system of the present invention may comprise air washers on the air intake side of the conditioner unit or the energy recovery/regenerator unit and filters.

In accordance with one or more embodiments, a system of the present invention comprises control gates that may open or close a fluid connection between two or more sumps, may move between two or more set positions, and in some embodiments may seal one or more fluid connections between two or more sumps. In some embodiments, control gates may be positioned between each or between most of the media sections in the sumps in the conditioner unit and in the energy recovery/regenerator unit. In some embodiments, control gates may further or alternatively divide or split media sections, effectively varying the size of the sump sections. These gates, when closed, may seal, thus blocking the passage of fluid between media sections sumps or, when open, allow fluid to flow between sumps depending on the load requirements or anticipated load requirements of the system at any specified time. For example, in times of higher humidity and temperature, (dehumidifying and cooling load) or low temperature and humidity (high heat load), one or more gates can be opened to expand the sump section that flows to the energy recovery/regenerator unit. In some embodiments, one or more of the sump to the storage system, the sump acting as the storage system, or the sump that recirculates back into the conditioner will effectively contract with the closing or sealing of the gates.

In some embodiments, at times of lower humidity and temperature energy load, one or more gates can be closed or sealed to allow fewer media section sumps to flow to the energy recovery/regenerator unit. One or more of the sump to the storage system, the sump acting as the storage system, or the sump that recirculates back to the conditioner unit will effectively expand with the opening of the gates. Thus, one or more gates will be opened or closed to improve the system performance and follow or anticipate the energy load. In some embodiments, the energy recovery/regenerator unit has one or more of a sump that flows to a storage unit, a sump which itself acts as a storage unit, and a sump that recirculates back into the energy recovery/regenerator unit. Some embodiments may comprise one or more gates that are openable, closable, moveable or sealable in order to improve the performance of the unit. Where there is more energy to recover and less flow from the storage unit or the sump which acts as the storage unit, in some embodiments the recirculating sump will be expanded by opening one or more gates. When there is more flow from the storage unit or the sump which acts as the storage unit, for regeneration, the one or more gates may close or seal off one or more compartments within the recirculating sump, effectively reducing the volume of desiccant recirculated.

In accordance with one or more embodiments, systems of the present invention control the flow and storage of liquid desiccant in order to follow or anticipate changes in the load. Thus, when conditions require, such as when the outside air is very warm and has high humidity levels, and more of the liquid desiccant in the first entry side media pads of the conditioner unit are becoming diluted and thus require more regeneration, one or more gates in that sump section and/or other sump sections will open, thereby including more media pads in the section, and allowing more diluted liquid desiccant to flow into the energy recovery/regenerator unit. When conditions are reversed and there is cool, drier air entering the conditioner unit, the liquid desiccant in the conditioner unit does less work, and the gates in the entry air side sump sections can be closed or sealed to effectively distribute the media pads into more sump sections, reducing the flow of liquid desiccant into the energy recovery/regenerator unit. In one embodiment, where there are three sump sections in the conditioner unit, at least one sump section in the conditioner unit that recirculates back into the conditioner unit may be contracted by closing one or more gates, for example at the air exit side. Further, one or more other sump section gates, for example close to the air entry side, may be opened, effectively expanding one sump or sump section while another sump or sump section is contracted. Under such circumstances, more or less of the desiccant in the former sumps, closest to the air exit, may recirculate directly back into the conditioner unit.

The present invention is a significant improvement over existing systems, for example the system described in Maisey et al. (U.S. Pat. No. 9,631,824, hereinafter "Maisey", the contents of which is incorporated herein by reference in its entirety). The LDAC system of Maisey includes multiple sumps in the conditioner unit and the regenerator/energy recovery unit, but the sumps have a fixed capacity, unlike the reconfigurable sumps of the present invention. Similarly, U.S. Pat. Nos. 9,377,207, 9,086,223, and 8,800,308 to Vandermeulen et al. describe an LDAC system that separates the desiccant based on its concentration, but the system lacks the flexibility to handle variable loads. U.S. Pat. No. 5,351,497 to Lowenstein and U.S. Pat. No. 6,513,339 to Kopko describe LDAC systems with fixed desiccant flow, in the regenerator (Lowenstein) or into a single sump (Kopko). The present invention advantageously is able to control the proportion of desiccant that flows to multiple sources during the operation of the LDAC using a system of movable gates, capturing the desiccant runoff of more or fewer media pads in each compartment of the sump depending on the configuration.

The gates of the present invention may be actuated by any suitable means, either automatically via a control system or manually. A control system may comprise one or more stepper motors, servo motors, solenoids, belts, pulleys, or any other suitable electromechanical actuation means. The control system may further comprise one or more microcontrollers or embedded computing devices, communicatively connected to one or more sensors and to the electromechanical actuation means for controlling the gates. In some embodiments, the control system comprises a thermostat, thermal couple, or other temperature sensor. In some embodiments, the control system comprises a humidity sensor or a barometric pressure sensor. In some embodiments, the control system comprises a wireless or wired network connection for communicating with the Internet, and is configured to download and interpret local weather information in order to configure the gates appropriately. In some embodiments, the control system comprises one or more desiccant level sensors positioned within the sump, communicatively connected to one or more microcontrollers or embedded computing devices. In some embodiments, the one or more desiccant level sensors are positioned within the various possible compartments, such that when the maximum number of gates are closed, each compartment formed by the closing of the gates has a desiccant level sensor positioned therein. The desiccant level sensor may be any suitable fluid level sensor known in the art, including but not limited to a capacitive sensor, a resistive sensor, an optical sensor, or a combination thereof.

The microcontroller or embedded computing device may therefore be configured to measure temperature, humidity, desiccant level, or any other relevant parameter in order to open or close the gates via the electromechanical actuators.

Referring now to FIG. 1, an exemplary LDAC system is shown. The LDAC system of FIG. 1 comprises a conditioner unit PART 1, a storage unit 301 and an energy recovery/regenerator unit PART 2. The conditioner unit PART 1 as shown has three sumps 102, 103, and 104, but it is understood that a conditioner unit of the present invention may have more or fewer than three sumps as appropriate. As shown, sump 102 circulates liquid desiccant to the energy recovery/regenerator unit PART 2. Sump 103 circulates liquid desiccant to the storage unit 301, or may in some embodiments retain liquid desiccant in sump 103 or another sump which acts as a storage unit. Sump 104 circulates liquid desiccant back into the conditioner unit PART 1. In some embodiments, the energy recovery/regenerator unit PART 2 may comprise two sumps. A first sump 103 circulates liquid desiccant to the storage unit 301 or may in some embodiments retain liquid desiccant in sump 103 or another sump which acts as a storage unit. Sump 102 recirculates the liquid desiccant back into the energy recovery/regenerator unit PART 2.

Figure 2A:
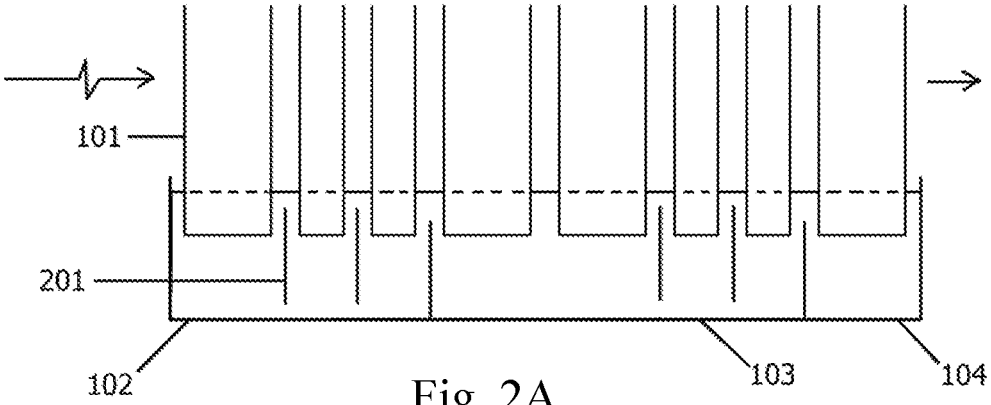
FIG. 2A is an exemplary schematic of a conditioner unit of an LDAC system.

Referring now to FIG. 2A, an LDAC system's conditioner unit is shown with air primarily flowing from left to right. As shown, the conditioner unit comprises three sumps. Sump 102 circulates liquid desiccant to the energy recovery/regenerator unit. Sump 103 circulates liquid desiccant to the storage unit or remains in this or another sump which acts as a storage unit. Sump 104 circulates the liquid desiccant back into the conditioner unit. Also shown are six gates 201 positioned in the sumps between the media pads 101. In some embodiments, the gates may split some of the media pads 101, such that a single pad is positioned in multiple sumps, the sumps separated by one or more gates 201. In one example, when there is a peak load on the system, the first several media pads 101 on the air intake end (the left side as shown) will transfer more energy and moisture due to the high temperature and/or humidity of the intake air. In such situations, the liquid desiccant that reaches the sumps on the left side will be highly saturated. In some embodiments, the system of the present invention compensates by opening one or more of the gates 201 near the intake side, allowing for desiccant in the enlarged sump or sumps to flow directly to the energy recovery/regenerator unit. In some embodiments, fewer of the gates 201 near the outlet end (the right side as shown) will be opened.

Figure 2B:
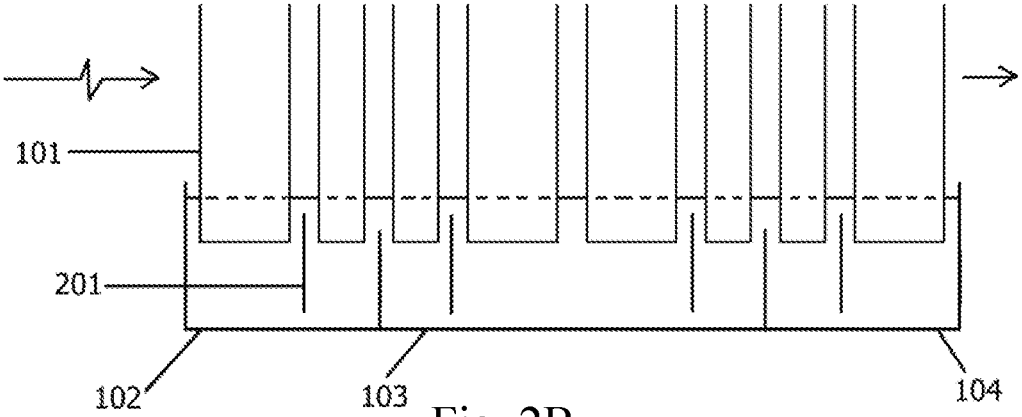
FIG. 2B is an exemplary schematic of a conditioner unit of an LDAC system.

Referring now to FIG. 2B, another configuration of an LDAC conditioner unit of the present invention is shown, again with air flowing from left to right. As shown, the conditioner unit effectively has the same three sumps 102, 103, and 104 as shown in FIG. 2A, but in FIG. 2B, the sumps are of different sizes due to a different gate configuration. FIG. 2B is a representative configuration of one embodiment of an LDAC system handling an average load. As shown, the first several media pads 101 on the air intake (left) end will still be performing most of the energy and moisture transfer, but when the system load is average, the liquid desiccant that reaches the sumps on the left side will be less saturated. In this embodiment, fewer of the gates 201 near the intake (left) end are opened than during a peak load as shown in FIG. 2A. Thus, sump 102 is effectively smaller, thereby conserving energy.

Figure 2C:
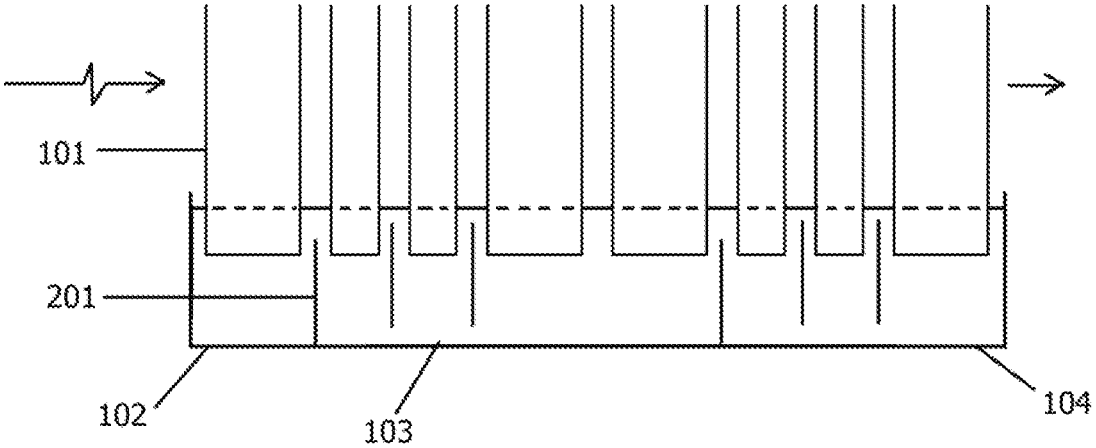
FIG. 2C is an exemplary schematic of a conditioner unit of an LDAC system.

Referring now to FIG. 2C, another configuration of an LDAC conditioner unit of the present invention is shown, again with air flowing from left to right. The conditioner unit has the same three sumps 102, 103, and 104 as shown in FIGS. 2A and 2B, but the sumps are of different sizes due to a different gate configuration. FIG. 2C is a representative configuration of one embodiment of an LDAC system handling a low load. The leftmost media pads 101 again perform most of the energy and moisture transfer, but due to the low load, the liquid desiccant that reaches the leftmost sumps will not be very saturated. In this case, fewer of the gates 201 near the intake end will be opened. This has the effect of shrinking sump 102 even more so than in FIG. 2B, further conserving energy, because less liquid desiccant is recirculated back to the energy recovery/regenerator unit.

Figure 3A:
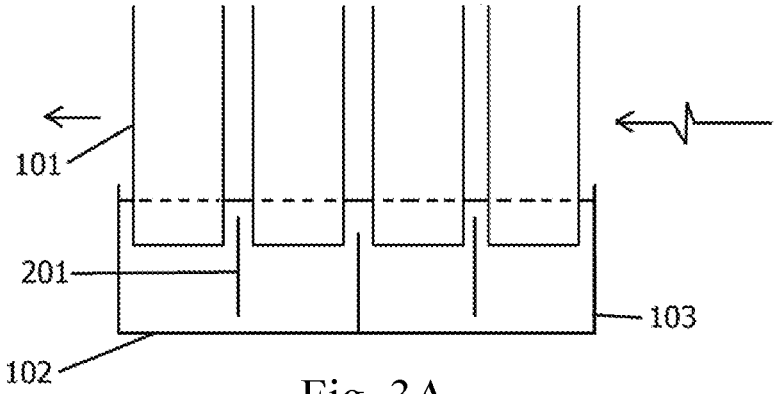
FIG. 3A is an exemplary schematic of the energy recovery/regenerator unit of an LDAC system.

Referring now to FIG. 3A, an LDAC system's energy recovery/regenerator unit is shown with air primarily flowing from right to left. As shown, the energy recovery/regenerator unit comprises two sumps 102 and 103. Sump 102 circulates the liquid desiccant back into the energy recovery/regenerator unit, and sump 103 directs the liquid desiccant into a storage unit. In some embodiments, sump 103 acts as a storage unit, or directs the liquid desiccant into another sump functioning as a storage unit. The exemplary energy recovery/regenerator unit further comprises three gates 201 positioned in the sump between the media pads 101. In some embodiments, the gates may split some of the media pads 101, such that a single pad is positioned in multiple sumps, the sumps separated by one or more gates 201. In some embodiments, the depicted configuration is used for an average load. The first several media pads 101 on the air intake side (right) perform most of the energy and moisture transfer, because the liquid desiccant flowing into the energy recovery/regenerator unit is highly saturated. In this case, the gates are configured to form two sumps of roughly equal size, wherein about half of the liquid desiccant is recirculated back into the energy recovery/regenerator unit and the other half flows into storage.

Figure 3B:
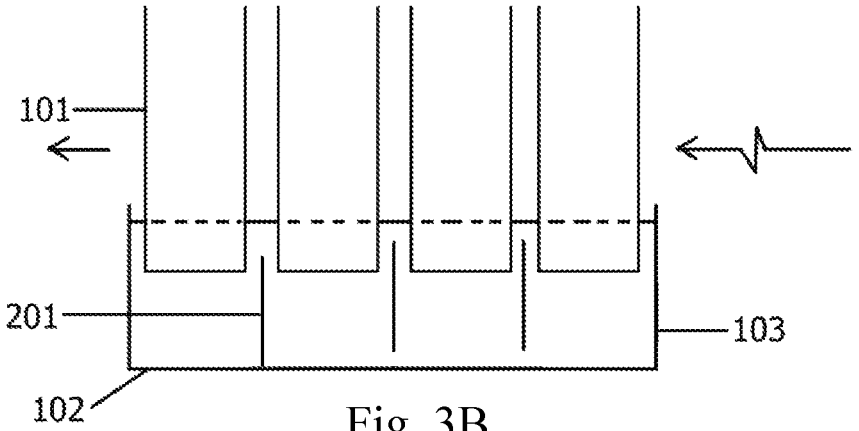
FIG. 3B is an exemplary schematic of the energy recovery/regenerator unit of an LDAC system.

Referring now to FIG. 3B, an LDAC system's energy recovery/regenerator unit is shown with an alternative gate configuration, with air again primarily flowing from right to left. In one embodiment, the depicted configuration may be used when there is a low load on the system. When the load is low, the media pads 101 closest to the air intake end are not required to transfer as much energy and moisture, so more of the gates 201 near the intake end open to allow for them to flow directly to the storage unit or remain in the sump acting as the storage unit 301. When the system is under lower load, the desiccant flowing into the energy recovery/regeneration unit is not as saturated as when the system is under a higher load, so the sumps are divided so that the recirculation sump 102 is smaller, while the sump flowing into the storage unit is larger.

Figure 3C:
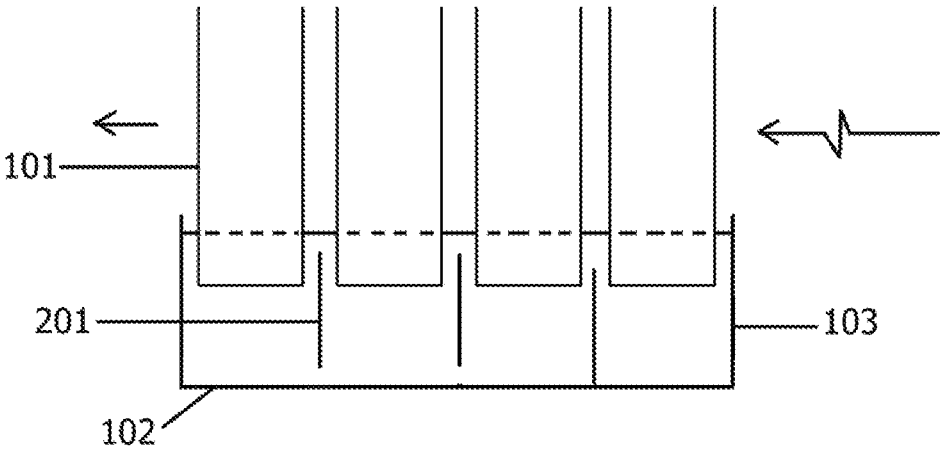
FIG. 3C is an exemplary schematic of the energy recovery/regenerator unit of an LDAC system.

Referring now to FIG. 3C, an LDAC system's energy recovery/regenerator unit is shown with an alternative gate configuration, with air again primarily flowing from right to left. In this exemplary configuration, fewer of the gates 201 near the intake (right) end are opened, and more gates near the exhaust (left) end are opened. This effectively enlarges sump 102 while shrinking sump 103, meaning that more of the desiccant is recirculated for further energy recovery.

Figure 4:
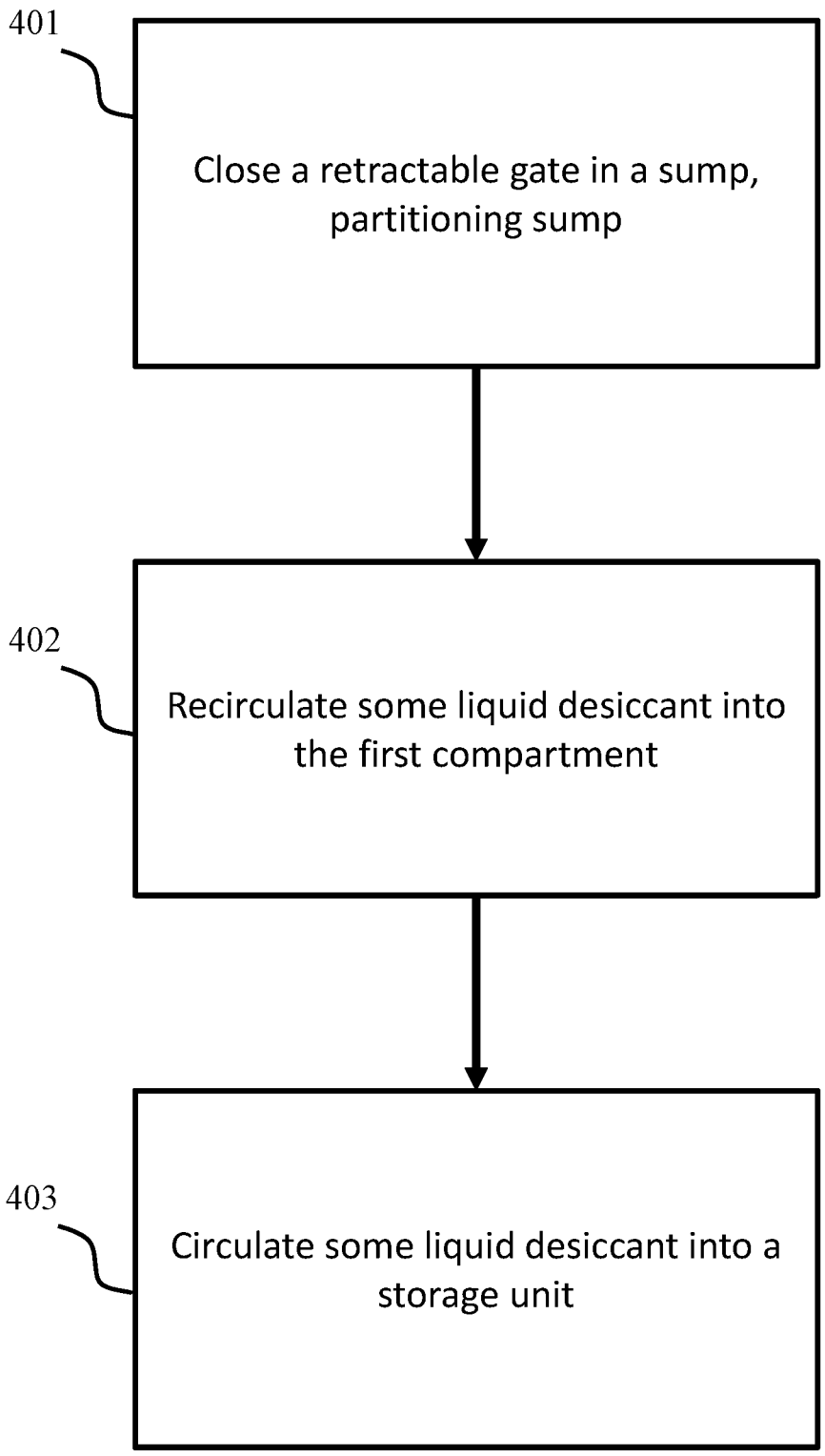
FIG. 4 is a diagram of a method of the present invention.

Referring now to FIG. 4, a method of the present invention is shown. As depicted, a method of controlling desiccant circulation in a liquid desiccant air conditioning system, comprises the steps of closing a first retractable gate in an energy exchange unit having a plurality of media pads and a sump, wherein the gate partitions the sump into first and second compartments 401, circulating a quantity of liquid desiccant from the first compartment back into the energy exchange unit 402, and circulating a quantity of liquid desiccant from the second compartment into a storage unit 403.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

What is claimed is:

1. A liquid desiccant air conditioning system, comprising:

an energy exchange unit comprising a sump and a plurality of media pads positioned above the sump;

first and second desiccant outlets fluidly connected to the sump; and at least one retractable gate positioned in the sump, configured to partition the sump into at least first and second compartments when the at least one retractable gate is closed; and wherein when the at least one retractable gate is closed, the first compartment is fluidly connected to the first desiccant outlet and the second compartment is fluidly connected to the second desiccant outlet.

2. The system of claim 1, wherein the first desiccant outlet is fluidly connected to a recirculating desiccant inlet of the energy exchange unit.

3. The system of claim 1, wherein the second desiccant outlet is fluidly connected to a storage unit.

4. The system of claim 1, farther comprising a third desiccant outlet fluidly connected to the sump;

wherein the at least one retractable gate positioned in the sump is further configured to partition the sump into a third compartment, the third compartment fluidly connected to the third desiccant outlet; and wherein the third desiccant outlet is fluidly connected to a second energy exchange unit.

5. The system of claim 4, wherein the second desiccant outlet is fluidly connected to a storage unit.

6. The system of claim 1, herein the second desiccant outlet is fluidly connected to a second energy exchange unit.

7. The system of claim 4, wherein the second desiccant outlet is fluidly connected to a second energy exchange unit.

8. The system of claim 1, wherein the at least one retractable gate is configured to partition the sump such that at least one media pad is positioned partially in one compartment and partially in another compartment.

9. The system of claim 1, further comprising a control system comprising a temperature sensor and an actuator, the actuator configured to actuate the at least one retractable gate in response to a signal received from the control system.

10. The system of claim 9, wherein the control system further comprises a humidity sensor communicatively connected to the control system.

11. The system of claim 9, wherein the control system further comprises at least one desiccant level sensor positioned in the sump.

12. The system of claim 11, wherein when the at least one retractable gate is closed, a first desiccant level sensor is positioned in the first compartment and, a second desiccant level sensor is positioned in the second compartment, the first and second desiccant level sensors communicatively connected to the control system.

13. A liquid desiccant air conditioning system, comprising:

an energy exchange unit comprising a sump and a plurality of media pads positioned above the sump;

first and second desiccant outlets fluidly connected to the sump; and at least first and second retractable gates positioned in the sump, configured to partition the sump into at least first and second compartments;

wherein when the first retractable irate is closed and the second retractable gate is open, the first compartment has a first volume and is fluidly connected to the first desiccant outlet, and the second compartment has a second volume and is fluidly connected to, the second desiccant outlet; and wherein when the first retractable gate is open and the second retractable gate is closed, the first compartment has a third volume different from the first volume, and is fluidly connected to the first desiccant outlet, and the second compartment has a fourth volume different from the second volume and is fluidly connected to the second desiccant outlet.

* * * * *